United States Patent [19]

Hinckley

[11] 3,940,216

[45] Feb. 24, 1976

[54] APPARATUS FOR FORMING A NONWOVEN FIBROUS WEB

[75] Inventor: Thomas L. Hinckley, Millville, N.J.

[73] Assignee: Scott Paper Company, Philadelphia, Pa.

[22] Filed: Jan. 30, 1975

[21] Appl. No.: 545,499

[52] U.S. Cl. ..... 425/83; 19/155; 156/229; 156/305; 264/88; 425/115

[51] Int. Cl.[2] ..... B32B 5/12; B32B 7/14

[58] Field of Search ..... 425/80, 81, 82, 83, 363, 425/455, 505, 115; 264/175, 88; 19/155, 161 R, 163; 156/62.8, 161 R, 229, 291, 305, 324, 381, 497, 543, 587

[56] References Cited

UNITED STATES PATENTS 3,772,107 11/1973 Gentile et al. ..... 425/81

*Primary Examiner*—Ronald J. Shore
*Assistant Examiner*—R. J. Charvat
*Attorney, Agent, or Firm*—Martin L. Faigus; William J. Foley

[57] ABSTRACT

This invention relates to an apparatus for forming a nonwoven fibrous web from multiple laps of staple fibers. The apparatus includes lap forming means for forming the laps of staple fibers and for generating air currents. A lap-confining channel is defined in part by an upper horizontal run of a substantially air-impervious conveyor belt, and the horizontal run directs the laps through an open downstream end of the channel. A shield encloses the downstream end of each lap forming means for defining an enclosed flow path from each lap forming means to the lap-confining channel. This enclosed flow path aids in establishing laminar flow of the air currents to form air barriers between adjacent laps, and between the upper horizontal run of the conveyor belt and its adjacent lap. A fiber spreading and reorienting section is positioned adjacent the downstream open end of the lap-confining channel and includes a plurality of bowed rolls spaced from each other in the machine-direction of web formation with their axles extending in the cross-machine-direction of web formation. The axles are disposed along a generally upwardly inclined path from the horizontal run of the conveyor belt in the machine-direction of web formation, and this generally upwardly inclined path is at an acute angle to the direction of movement of said horizontal run. The most upstream roll of the fiber spreading and reorienting section, that is, the roll closest to the upper horizontal run of the conveyor belt, is in adjacent, non-contacting relationship with the horizontal run of the conveyor belt for receiving the overlying laps without compressing them against the conveyor belt. A calendering section is disposed downstream of the fiber spreading and reorienting section for pressing the fibrous laps together into a unitary nonwoven fibrous web after the fibers in the laps have been spread and reoriented, and a bonding section is disposed downstream of the calendering section for bonding together the fibers of the unitary nonwoven fibrous web to enhance the integrity of the web.

4 Claims, 2 Drawing Figures

APPARATUS FOR FORMING A NONWOVEN FIBROUS WEB

BACKGROUND OF THE INVENTION

1. Field of the Invention

This invention relates to an apparatus for forming a nonwoven fibrous web, and more particularly to an apparatus for forming a nonwoven fibrous web from multiple laps of staple fibers.

2. Description of the Prior Art

Nonwoven webs of oriented staple length fibers are well known in the prior art, and have been conventionally formed on carding machines which orient the fibers predominately in the machine-direction of web formation. These webs have excellent machine-directon strength due to the predominate fiber orientation in that direction; however, this strength is obtained at a sacrifice of cross-machine-direction strength.

An improved apparatus for achieving enhanced cross-machine-direction strength in nonwoven fibrous webs formed from multiple laps of predominately machine-direction-oriented staple length fibers is disclosed in U.S. Pat. No. 3,772,107, issued to Gentile et al on Nov. 13, 1973, and assigned to Scott Paper Company. That apparatus includes a plurality of lap-forming means, preferably in the form of carding machines, for forming multiple laps of staple-length fibers and for directing said laps through an enclosed flow path into overlying relationship within a lap-confining channel. The carding machines generate air currents which are directed into the lap-confining channel under substantially laminar air flow conditions to form air barriers between the overlying laps and between the lower lap and the upper run of an air-impervious conveyor belt. The upper run of the conveyor belt is moved in a horizontal path through the lapconfining channel, and then is diverted upwardly at an acute angle to direct the laps into a horizontally disposed fiber spreading and reorienting section. The diversion of the upper run of the conveyor belt from its horizontal path into its upwardly inclined path takes place by directing the upper run around a conveyor diverting roll. The Gentile et al apparatus further includes a calendering section disposed downstream of the fiber spreading and reorienting section for pressing the adjacent overlying laps together to form a unitary nonwoven fibrous web after the fibers in the laps have been spread and reoriented, a bonding section disposed downstream of the calendering section for bonding together the fibers of the unitary nonwoven fibrous web and a drying section for both drying and curing the bonding material to complete the formation of the nonwoven web.

The Gentile et al apparatus was designed to prevent any significant compression of the laps until after the fiber spreading and reorienting operation. In this manner the air barriers formed between the overlying laps of staple fibers were maintained during the fiber spreading and reorienting operation to achieve a greater degree of fiber reorientation and randomization then was achievable when the laps were pressed into a unitary web construction prior to the spreading and reorienting operation. A complete discussion of the advantages of the Gentile et al apparatus is set forth in the U.S. Pat. No. 3,772,107, and for the purpose of brevity will not be repeated herein.

Although the Gentile et al apparatus accomplished its intended objective of forming a nonwoven fibrous web with enhanced cross-machine-direction strength, it has been found that at web forming speeds exceeding about 300 feet per minute (i.e.), the speed of web removal from the drying section) the finished nonwoven fibrous web consistently contained undesirable wrinkles extending in the machine direction of web formation.

SUMMARY OF THE INVENTION

The instant invention resides in an improvement of the Gentile et al apparatus and greatly reduces the frequency of wrinkle formation at web forming speeds exceeding 300 feet per minute. Specifically, applicant has discovered that in the Gentile et al device the upper run of the conveyor belt cooperates with the conveyor diverting roll to define an air-flow restricting gap which traps air immediately adjacent the upstream side of the diverting roll during the web forming operation. The air which is trapped adjacent the diverting roll builds up to cause the laps to lift off of the conveyor belt in the form of a fiber bubble. As the fibrous laps are continuously directed toward the diverting roll the fiber bubble is forced to continuously collapse and pass through the restricting gap. This collapsing of the fiber bubble creates wrinkles which are generally aligned in the machine-direction of web formation, and therefore, these wrinkles are not pulled out of the laps by tension imposed upon said laps as they are directed through the subsequent calendering, bonding and drying operations. Accordingly, the wrinkles are included in the completed nonwoven fibrous web, and render said web unacceptable for many end uses.

Applicant has solved the wrinkling problem described in the preceding paragraph by eliminating both the conveyor diverting roll and the upwardly inclined section of the conveyor belt from the Gentile et al apparatus. In the apparatus of this invention a fiber spreading and reorienting section is disposed adjacent the horizontal delivery run of the conveyor belt to receive the overlying laps of staple fibers, with the air barriers trapped therebetween, directly from said horizontal delivery run. The fiber spreading and reorienting section is comprised of a plurality of bowed rolls spaced from each other in the machine-direction of web formation with their axles extending in the cross-machine-direction of web formation. The axles are disposed along a generally upwardly inclined path from the horizontal run of the conveyor belt in the machine-direction of web formation, and this generally upwardly inclined path is at an acute angle to the direction of movement of said horizontal run. The generally upwardly inclined path can be a straight path resulting from positioning successive roll axles along a straight line, or said path can be an undulating path resulting from offsetting adjacent roll axles from each other. Regardless of the disposition of the roll axles, the overlying laps of staple fibers are directed past the bowed rolls along a path, the straight line approximation of which is upwardly inclined from the horizontal delivery run of the conveyor belt at an acute angle to the direction of movement of said horizontal delivery run. The overlying laps of staple fibers can be threaded through the bowed rolls so as to engage each of said rolls, or alternatively, some of said rolls can be bypassed, depending upon the degree of fiber spreading and reorientation that is desired.

In the preferred embodiment of this invention the axles of adjacent rolls are offset with respect to each other so that the outer surfaces of successive rolls overlap to define an undulating fiber spreading and reorienting path between them. The straight path approximation of the undulating path is upwardly inclined from the horizontal delivery run of the conveyor belt and is disposed at an acute angle to said horizontal delivery run. Regardless of the orientation of the bowed rolls, the most upstream roll, i.e., the roll closest to the upper horizontal run of the conveyor belt, is in adjacent, noncontacting relationship with the horizontal run for receiving the laps without compressing said laps or restricting the flow of air. In this manner the formation of fiber bubbles and the wrinkles resulting therefrom have been eliminated.

The fiber spreading and reorienting section of the apparatus of this invention provides the same function as the fiber spreading and reorienting section in the Gentile device, and in addition performs the lap directing function which, in the Gentile et al device, required the inclusion of an upwardly inclined conveyor belt run and a conveyor diverting roll. Accordingly the apparatus of this invention is of a simplified construction producing considerably better results than the Gentile et al device. Specifically, the apparatus of this invention has been employed to form unitary nonwoven fibrous webs at speeds in excess of 400 feet per minute without the formation of wrinkles therein.

Other objects and advantages of this invention will become apparent upon reading the detailed description which follows taken in conjunction with the drawings.

DESCRIPTION OF THE PREFERRED EMBODIMENT OF THE INVENTION

This invention relates to an improvement over the apparatus described in U.S. Pat. No. 3,772,107, issued to Gentile et al on Nov. 13, 1973, and assigned to Scott Paper Company. Subject matter of the Gentile et al patent is incorporated by reference into this application to the extent necessary to provide a complete understanding of the operation of the instant invention and the environment in which said instant invention is employed.

Figure 1:
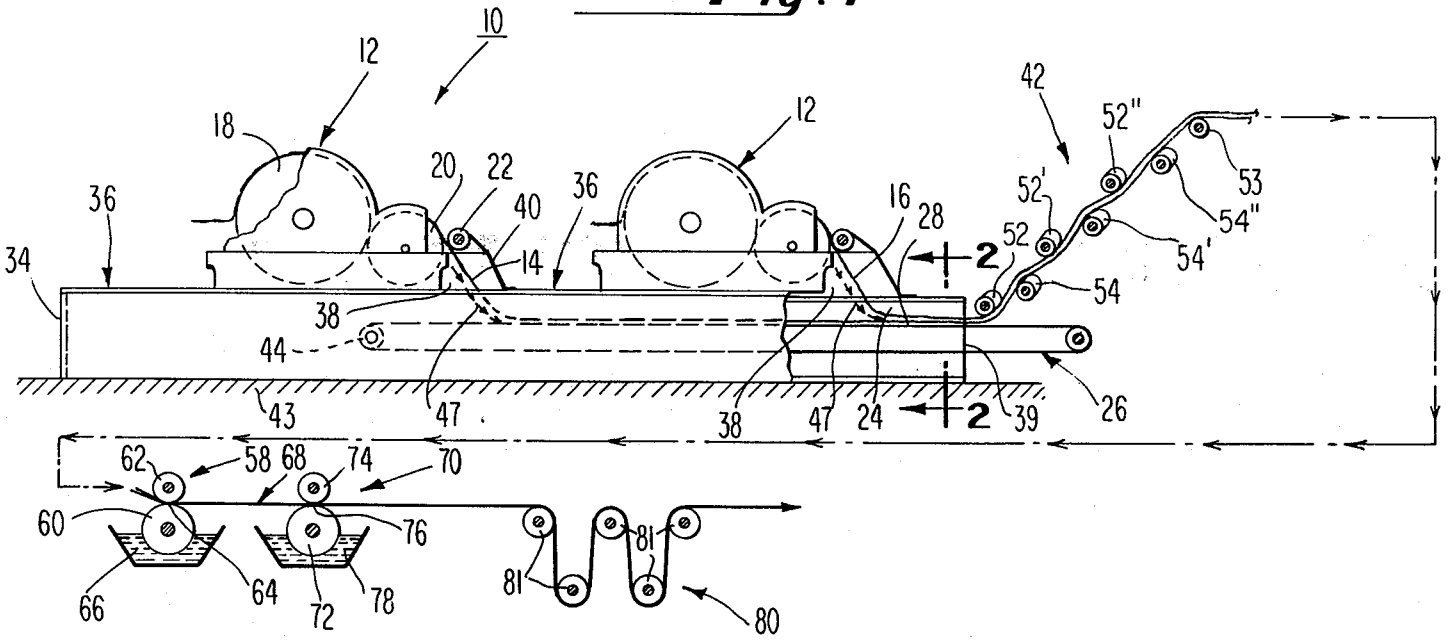
FIG. 1 is a schematic side elevation of an apparatus according to this invention.

Referring to FIG. 1, an apparatus 10 of this invention for forming a nonwoven fibrous web includes conventional lap forming means, such as carding machines 12, for forming laps 14 and 16 of loosely associated staple fibers, the major proportion of which are predominately oriented in the machine-direction of lap formation. Each carding machine 12 includes a carding roll 18 having a plurality of pins or wire points (not shown) disposed about the periphery thereof for combing fibers from a feed mat of staple fibers to orient a major proportion of said fibers substantially in the machine-direction. In addition, the carding machine 12 includes a doffing roll 20 for collecting and removing the oriented fibers from the carding roll 18 in the form of a fibrous lap. Suitable lap removing means 22; such as that which is sold under the trademark "Doffmaster" by John D. Hollingsworth on Wheels, Inc. of Greenville, South Carolina; is disposed adjacent the doffing roll 20 of each carding machine 12 for removing the laps from the doffing roll and for directing said laps into overlying relationship onto an upper horizontal delivery run 28 of an air-impervious continuous conveyor belt 26.

Figure 2:
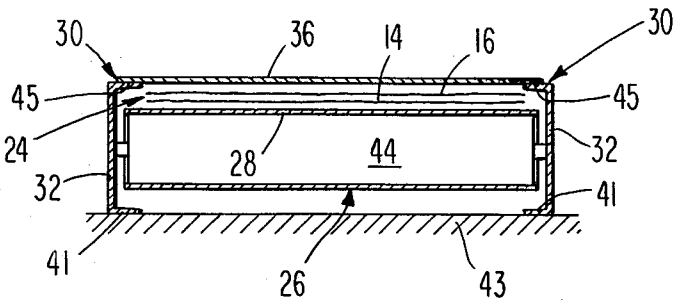
FIG. 2 is a sectional view along line 2—2 of FIG. 1.

Referring to FIGS. 1 and 2, a lap-confining channel 24 is defined by the upper horizontal delivery run 28 of the continuous conveyor belt 26; a pair of transversely spaced, substantially U-shaped side members 30, each of which has a central web portion 32 disposed closely adjacent to a respective side margin of the upper delivery run 28 of the conveyor belt 26; a back member 34 and an upper closure. The upper closure preferably is defined by discrete members 36 which are spaced apart in the machine-direction to define entrance openings 38 through which the fibrous laps 14 and 16 are directed into the lapconfining channel 24. Each side member 30 preferably has a lower inturned leg 41 which is secured to a floor 43 by any suitable securing means (not shown), and an upper inturned leg 45 to which the closure members 36 are secured by any suitable securing means (not shown). The lap-confining channel 24 has an open downstream end 39 through which the superimposed fibrous laps 14 and 16 are directed by the conveyor belt 26.

The individual laps 14 and 16 are directed from the carding machines 12 through respective entrance openings 38 by the Doffmaster 22 into overlying relationship within the lap-confining channel 24. High speed rotation of the carding roll 18, preferably in excess of 200 feet per minute, drives air into the lap-confining channel 24, as is shown schematically by arrows 47, to form an air barrier between the individual fibrous laps 14 and 16, and between the upper delivery run 28 of the conveyor belt 26 and its adjacent fibrous lap 14. The air barrier between the delivery run 28 of the conveyor belt 26 and the lower lap 14 prevents the buildup of static charges between said lower lap and said delivery run. The air barrier between the fibrous laps 14 and 16 prevents extensive clinging together of the fibers of lap 14 with the fibers of its adjacent lap 16 to permit more effective reorientation among the fibers in the adjacent laps, as is fully explained in the above-referred to Gentile et al patent. The lap-confining channel 24 aids in establishing laminar air flow of the air barriers by confining the flow path of said air to a substantially downstream direction. For further details relating to the function performed by the various members forming the lap-confining channel 24 reference should be had to the Gentile et al patent.

An air-impervious shield 40 is disposed adjacent the downstream end of each carding machine 12 and encloses the front and sides of each machine to define a substantially enclosed flow path from each carding machine 12 to a respective entrance opening 38 of the lap-confining channel 24 to thereby aid in establishing the laminar air flow from each carding machine 12 into the lap-confining channel 24, and to insure that each lap will be directed through its corresponding entrance opening 38.

The components of the appatatus 10 described thus far are identical to the Gentile et al apparatus. The present invention resides in the unique relationship between the upper horizontal delivery run 28 of the air-impervious conveyor belt 26 and a fiber spreading and reorienting section 42.

Referring to FIG. 1, the upper delivery run 28 of the air-impervious conveyor belt 26 is disposed in a substantially horizontal plane for directing the overlying laps 14 and 16 in a downstream direction through the open downstream end 39 of the lap-confining channel 24 into the fiber spreading and reorienting section 42.

The fiber spreading and reorienting section 42 includes a plurality of bowed rolls (preferably of the type sold under the trademark "Mount Hope" by Mount Hope Machinery Company of Tauton, Massachusetts) spaced from each other in the machine direction of web formation. The number of these rolls can be varied, depending upon the desired degree of spreading and reorienting. In the embodiment depicted for illustration only, six bowed rolls are shown, and are designated by numerals 52, 54, 52', 54', 52'' and 54''. Preferably, the outer surfaces of successive rolls overlap to define an undulating fiber spreading and reorienting path for the overlying laps 14 and 16 as said laps are directed between said successive rolls. The straight path approximation of the undulating path is upwardly inclined from the horizontal delivery run 28 and is disposed at an acute angle to the direction of movement of said delivery run. The most upstream bowed roll 52 of the fiber spreading and reorienting section 42 (i.e., the roll closest to the upper delivery run 28 of the conveyor belt 26) is in adjacent, noncontacting relationship with the horizontal delivery run 28.

The bowed rolls of the fiber spreading and reorienting section 42 spread and reorient the fibers in substantially the same manner as described in the Gentile et al patent; however the adjacent, noncontacting relationship between the delivery run 28 of the conveyor belt 26 and the most upstream roll 52 of said fiber spreading and reorienting section eliminates the creation of an air-flow restricting gap of the type which exits between the conveyor diverting roll and the conveyor in the Gentile et al device. Accordingly, the problem of fiber bubbles and web wrinkles is eliminated in the device of this invention.

Preferably the bowed rolls 52, 52' and 52'' (hereinafter referred to as the "upper rolls") are mounted so that they can be moved upwardly to move their outer surfaces out of overlapping relationship with the outer surfaces of the bowed rolls 54, 54' and 54'' (hereinafter referred to as "the lower rolls"). Accordingly, threading the laps 14 and 16 through the fiber spreading and reorienting section is easily achieved by moving the upper rolls to a position in which their outer surfaces do not overlap with the outer surfaces of the lower rolls, and merely directing the laps over the lower rolls. Thereafter the upper rolls can be lowered to engage the laps as is shown in FIG. 1.

After the fibers in laps 14 and 16 have been spread and reoriented the laps are directed into a wet calendering section 58 over a guide roll 53. If desired additional bowed rolls (not shown) can be included between the guide roll 53 and the calendering section 58 to further spread and reorient the fibers within the laps 14 and 16.

The wet calender section includes opposed driven rolls 60 and 62 defining a nip 64 therebetween. The lower roll passes through a wetting solution 66, and conveys the wetting solution to the nip 64 to accomplish wet pressing of the laps 14 and 16 in said nip to form a unitary nonwoven fibrous web 68. the nonwoven fibrous web 68 is then directed through a bonding section 70 which preferably is a print bonding section comprising opposed, driven roll 72 and 74 defining a nip 76 therebetween. The lower roll 72 passes through an adhesive solution 78, and conveys said solution into the nip 76 to bond fibers together in the unitary nonwoven fibrous web 68. Preferably, the lower print bonding roll 72 is patterned to pick up adhesive in discrete patterns to thereby form discrete bonded areas in the nonwoven fibrous web 68 which account for less than 25% of the total area of said web, and preferably account for 10% or less of the total area of said web. The wet calendering operation prior to the bonding operation prevents wrap-up of the nonwoven fibrous web 68 around either of the bonding rolls 72, 74. If a spray bonding section is utilized to bond together fibers of the nonwoven web 68, the wet calendering section 58 may be replaced by a dry calendering section, since there is no wrap-up problem associated with a spray bonding operation.

A dryer section 80 is disposed downstream of the bonding section 70, and preferably is comprised of a plurality of driven can dryers 81. The can dryers 81 dry the web to remove moisture therefrom, and also serve the function of setting and/or curing the adhesive. The dried web is then fed from the can dryers 81 onto a supply roll (not shown) for storage and/or subsequent use.

The staple fibers utilized in forming a nonwoven web in the apparatus of this invention preferably have a length exceeding one-half inch, and include such fibers as rayon, polyolefins, polyamides and polyesters.

Any suitable wetting solution can be utilized at the wet calendering section 58. For example, the wetting solution can include water with less than 1% of a wetting agent, such as DIANOL, sold by Quaker Chemical Company of Conshohocken, Pa.

Many different adhesives can be utilized to bond together fibers of the nonwoven web, and the specific type of adhesive utilized does not form a part of the present invention. Latices, such as polyvinyl acetate, copolymer emulsions and acrylic latices have been satisfactory utilized in the present invention.

The problem of web wrinkles was encountered in the Gentile et al device at web forming speeds of approximately 300 feet per minute (i.e., the speed of the web coming off of the dryer cans). However, under the same draw condition of about 15% the present invention has been employed to form fibrous webs at speeds exceeding 400 feet per minute without the creation of web wrinkles. This invention represents a significant improvement over the Gentile et al apparatus by permitting a higher speed more reliable web forming operation.

What is claimed is:

1. In an apparatus for forming a unitary nonwoven fibrous web from multiple laps of staple fibers:

A. lap forming means for forming said laps of staple fibers and for generating air currents;

B. a lap-confining channel defined in part by an upper, substantially horizontal delivery run of an air-impervious conveyor, said channel having an open down-stream end;

C. shield means for defining a flow path between the lap forming means and the lap-confining channel for directing said laps and air currents into said lap-confining channel with said laps in overlying relationship with each other and with the upper delivery run of the air-impervious conveyor;

D. drive means for moving said air-impervious conveyor to convey said overlying laps in a downstream direction through the open downstream end of said lap-confining channel; the improvement comprising:

E. a fiber spreading and reorienting section adjacent the upper delivery run of the conveyor downstream of the lap-confining channel, said fiber spreading and reorienting section including a plurality of bowed rolls spaced from each other in the machine direction of web formation with their axles extending in the cross-machine-direction of web formation, said axles being disposed along a generally upwardly inclined path from the horizontal delivery run of the conveyor, said generally upwardly inclined path being at an acute angle to the direction of movement of said delivery run, and the most upstream bowed roll of the fiber spreading and reorienting section being in adjacent, noncontacting relationship with the horizontal delivery run for receiving the overlying laps of staple fibers without compressing said laps against said delivery run.

2. The apparatus according to claim 1, wherein the axles of adjacent bowed rolls are offset from each other so that a line connecting successive axles follows an undulating path, the straight path approximation of said undulating path being upwardly inclined from the horizontal delivery run of the conveyor at an acute angle to the direction of movement of said delivery run.

3. The apparatus according to claim 2, wherein the outer surfaces of successive rolls overlap to define an undulating fiber spreading and reorienting path between said rolls through which the laps of staple fibers are directed, the straight path approximation of the undulating path being upwardly inclined from the upper delivery run of the conveyor at an acute angle to the direction of movement of said delivery run.

4. The apparatus according to claim 1, further including a calendering section disposed downstream of the fiber spreading and reorienting section for pressing the adjacent overlying laps together to form a unitary nonwoven fibrous web and a bonding section disposed downstream of the calendering section for bonding together fibers of said unitary nonwoven fibrous web.

* * * * *